United States Patent [19]

DiTullio

[11] 4,359,501

[45] Nov. 16, 1982

[54] HYDROLYSIS RESISTANT POLYARYLETHERKETONE FABRIC

[75] Inventor: Venanzio DiTullio, Perth, Canada

[73] Assignee: Albany International Corp., Albany, N.Y.

[21] Appl. No.: 315,925

[22] Filed: Oct. 28, 1981

[51] Int. Cl.[3] ..... B32B 5/06

[52] U.S. Cl. ..... 428/245; 139/383 R; 139/420 A; 428/259

[58] Field of Search ..... 428/245, 259; 139/383 R, 420 A

[56] References Cited

U.S. PATENT DOCUMENTS

| | | | |
|---|---|---|---|
| 1,991,366 | 2/1935 | Barrell | 139/410 |
| 2,091,926 | 8/1937 | Hill | 139/420 |
| 3,751,398 | 8/1973 | Dahl | 260/47 R |
| 4,070,519 | 1/1978 | Lefkowitz et al. | 428/235 |
| 4,159,618 | 7/1979 | Sokaris | 57/251 |
| 4,186,262 | 1/1980 | Freeman et al. | 528/125 |

FOREIGN PATENT DOCUMENTS

| | | |
|---|---|---|
| 1383393 | 2/1975 | United Kingdom . |
| 1387303 | 3/1975 | United Kingdom . |
| 1388013 | 3/1975 | United Kingdom . |

OTHER PUBLICATIONS

Attwood et al., Synthesis and Properties of Polyaryletherketones, *Polymer,* vol. 22, Aug. 1981, pp. 1096–1103.

Attwood et al., Synthesis and Properties of Polyaryletherketones, *ACS Polymer Preprints,* vol. 20, No. 1, Apr. 1979, pp. 191–194.

EPO patent application 78300314.8, filed Aug. 22, 1978, published May 16, 1979, entitled Thermaplastic Aromatic Polyetherketones, etc.

ICI Research Disclosure of May 1979, disclosure No. 18127 at p. 242.

A group of three ICI Plastics Division Provisional Data Sheets of Nov. 1979 on Polyetheretherketone.

*Primary Examiner*—Marion McCamish

*Attorney, Agent, or Firm*—Quarles & Brady

[57] ABSTRACT

An industrial fabric of woven monofilament threads comprised of a melt extrudable polyaryletherketone having hydrolysis resistance at elevated temperatures, such fabric exhibiting a high modulus of elongation making it suitable for conveying applications in various industrial processing.

7 Claims, 5 Drawing Figures

HYDROLYSIS RESISTANT POLYARYLETHERKETONE FABRIC

BACKGROUND OF THE INVENTION (a) Field of the Invention

The field of the present invention is woven fabrics of synthetic materials for use under high temperature conditions as may be encountered in papermaking and other industrial processes.

(b) Description of the Prior Art

Woven fabrics fashioned into endless belts for conveying and guiding products under manufacture are used in various industrial processes. Both metal and synthetic materials have been used for these belts, but numerous processes involve high temperature and high moisture conditions which ordinary synthetic materials cannot withstand. In such cases metallic thread materials are commonly used, and typical of these are fine wires of brass, bronze or steel. The wires are woven to form a flat fabric and then seamed at the fabric ends to form endless belts. Steels can withstand temperatures up to about 1000° F. (538° C.), and the brasses and brass alloys can be used for temperatures up to about 600° to 700° F. (316° to 371° C.). Metal fabrics, however, are often difficult to handle, do not wear well, have poor flexure resistance and are prone to damage. They may also chemically interact with the product being conveyed, or can readily corrode under adverse environments. Thus metal fabrics have had severe limitations.

Two synthetic materials that have found some use in high temperature applications are a polymer of m-phenylenediamine and isophthaloyl chloride known as Nomex, and an aramid known as Kevlar, as reported in U.S. Pat. No. 4,159,618. These materials are twisted from multifilaments, or staple fibers into yarns, and are not available for applications where monofilament threads are preferred. Having a relatively rough, porous surface a multifilament can be difficult to keep clean in applications where contaminants are a problem, and for this reason Nomex and Kevlar yarns are sometimes coated with suitable resins to simulate monofilaments. These composite yarns can be woven or knitted into fabrics useful in such applications as conveying belts for dryer sections of a paper machine, where elevated temperatures are frequently encountered. However, under extended exposure to dry or moist heat there can be a severe loss in tensile strength, as further reported in said patent.

Another synthetic material that is woven from monofilaments into fabrics for use as industrial conveying and guiding belts is polyester. It has gained widely accepted usage in forming, press and dryer sections of papermaking machines because of its abrasion resistance, ability to flex, dimensional stability after being thermoset, chemical inertness, and ease of handling. Over the years techniques have been developed for weaving, thermosetting and seaming polyester threads and fabrics, so that this material can be readily handled in the manufacture of endless belts. Polyester consequently enjoys wide acceptance; however, this material has poor high temperature hydrolytic stability, and cannot be satisfactorily used under moist conditions at continuous, elevated temperatures. In papermaking applications, for example, it can be a limiting factor for the temperatures under which drying processes can be carried out, and where high temperatures are desired some other thread material must be resorted to.

In other manufacturing processes, too, such as in continuous drying or curing ovens for heat treating a product it is advantageous to employ conveying belts that can withstand high temperature and moisture conditions for the processing. In some installations coarsely woven metal belts, or belts constructed of metal links may be satisfactory, but where high speed operation or some other criteria dictates a different belt material, then there has not been a satisfactory answer for meeting belt requirements in high temperature applications. The present invention provides a response to these problems.

SUMMARY OF THE INVENTION

The invention herein resides in a fabric containing synthetic, polymeric threads that can be woven, thermally set, and fashioned into endless belts using known manufacturing techniques that have improved hydrolysis resistance in order to withstand hot environments that are either moist or dry.

The fabrics of the present invention have interwoven warp and shute thread systems in which one or both of the thread systems include monofilaments of polyaryletherketone polymers. The polyaryletherketones can be extruded into monofilament threads and then woven and heat set to obtain a fabric having good wear qualities, adequate flexibility for moving across and around machine elements, chemical inertness and dimensional stability. One application for such fabrics is in dryer sections of papermaking machines, particularly through-air type dryers wherein a paper web supported and conveyed by the fabric is brought into contact with and drawn around the surface of a perforate drum that passes heated air through the paper web and the fabric to remove water from the web. Such through-air dryers operate under temperature and moisture conditions which tax the ability of polyester and other synthetic fabrics to maintain their physical characteristics, particularly hydrolytic resistance. At over about 400° F. (204° C.), the mechanical properties of polyesters rapidly decline, so that they are no longer suitable for use. Therefore, when polyester fabrics are used, dryer temperatures must be regulated to keep within the permissible operating parameters of the polyester. The other synthetic materials, Nomex and Kevlar, may operate at higher temperatures, but they also show poor hydrolysis resistance upon extended exposure to hot, moist conditions.

Fabrics incorporating polyaryletherketone monofilaments, on the other hand, can withstand continuous operating temperatures as high as 500° F. (260° C.) in the presence of a hydrolyzing media. This makes such fabrics highly advantageous for through-air dryer applications, and allows the paper drying operation to be carried out under more optimal conditions at increased temperatures. Fabrics woven from monofilaments of such material may also be employed in other processing where resistance to hydrolysis at high temperatures is a particularly important characteristic. Examples are belting for drying ovens, paper machine dryer section clothing, paper forming fabrics operating under hot, moist conditions including exposure to high pressure steam impingement, fabric for press-drying paper, and similar applications.

It is an object of the invention to provide an industrial fabric of synthetic, polyaryletherketone material having improved high temperature hydrolytic stability.

It is another object of the invention to provide a fabric having such stability that includes polyaryletherketone thread material that can be woven and thermally set using known equipment and techniques in order to facilitate production of the fabric.

A further object is to provide such a fabric that in addition to exhibiting hydrolytic and thermal stability has other desired characteristics of dimensional stability, flexure, good wear life, and the like, so as to be suitable for a wide range of applications including high speed operation in papermaking machines.

The foregoing and other objects and advantages of the invention will appear from the following description. In the description reference is made to the accompanying drawings which form a part hereof, and in which there is shown by way of illustration preferred embodiments of the invention. Such embodiments do not necessarily represent the full scope of the invention, however, and reference is made therefore to the claims herein for interpreting the scope of the invention.

DESCRIPTION OF THE PREFERRED EMBODIMENTS

Figure 1:
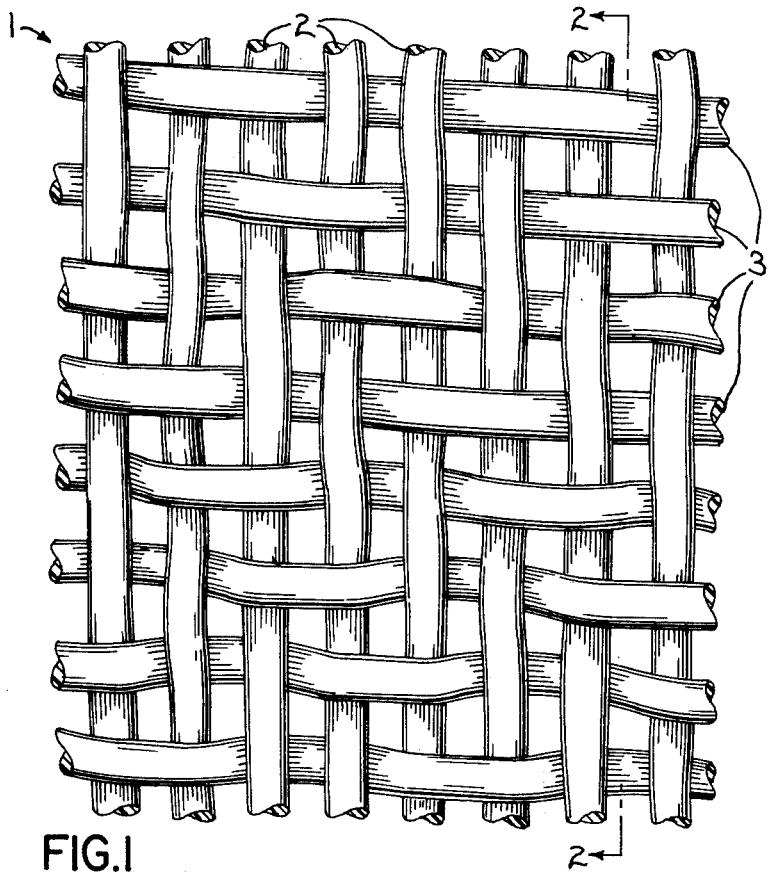
FIG. 1 is a fragmentary plan view of a fabric of the invention woven in a 2×2 weave.

Referring to FIG. 1 of the drawings, there is shown in plan view a portion of a woven fabric 1 suitable for an oven type dryer of a papermaking machine. It has monofilament warp threads 2 of polyaryletherketone polymeric material extending lengthwise, or in the running direction, of the fabric. When installed on a paper machine these threads 2 are said to extend in the machine direction. The fabric also has monofilament shute threads 3 of polyaryletherketone material extending transversely of the fabric, or in the cross machine direction when installed on a paper machine.

Figure 2:
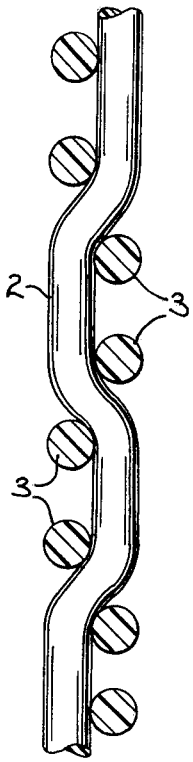
FIG. 2 is a view in cross section of the fabric of FIG. 1 taken through the plane 2—2 indicated in FIG. 1.

The monofilament warp threads 2 and shute threads 3 are woven in conventional manner on a loom, and after weaving the fabric 1 is thermally set to provide dimensional stability, in similar manner as for other synthetic, polymeric papermaking fabrics. As seen in FIG. 2, the warp threads 2 are interwoven with the shute threads 3 in a 2×2 weave of passing over a pair of shute threads 3, then interlacing through the fabric 1 and passing under a pair of shute threads 3 to complete a weave repeat. The shute threads 3 are likewise in a 2×2 weave, and as seen in FIG. 1 the fabric 1 is woven in a twill pattern, in which the knuckles of adjacent warp threads 2 on the upper side of the fabric 1 are successively offset from one another in the machine direction by a single shute thread 3.

A fabric of the weave and pattern shown in FIG. 1 was woven flat on a loom in a mesh count of 20 warp threads per inch at the reed with both warp and shute threads having a nominal diameter of 0.020 inch. After weaving, the fabric was thermally set under heat and tension to a final warp count of 24 threads per inch and a shute count of 20 threads per inch. The weaving and heat setting techniques followed known procedures for manufacturing fabrics from other synthetic materials, namely forming the fabric into an endless belt by use of a temporary seam and holding the fabric in tension while heating it to a preselected temperature as it is run over a set of rolls. The heat setting temperature, however, was higher than normally used for other materials, such as polyester. A temperature of 500° F. (260° C.) has been used, but this is exemplary only and other temperatures, as well as variations in tensions and time may be used in the heat setting process to produce desired thread counts and knuckle formation, much the same as for other fabric materials.

After heat setting the warp knuckles were receded within the shute knuckles on both sides of the fabric by about 0.011 inch and the fabric thickness was about 0.051 inch. Since the fabric 1 was woven flat, it was fashioned into an endless belt after heat setting by cutting to size, if necessary, and joining the fabric ends with a permanent looped pin seam using the same thread material for the pin.

Figure 3:
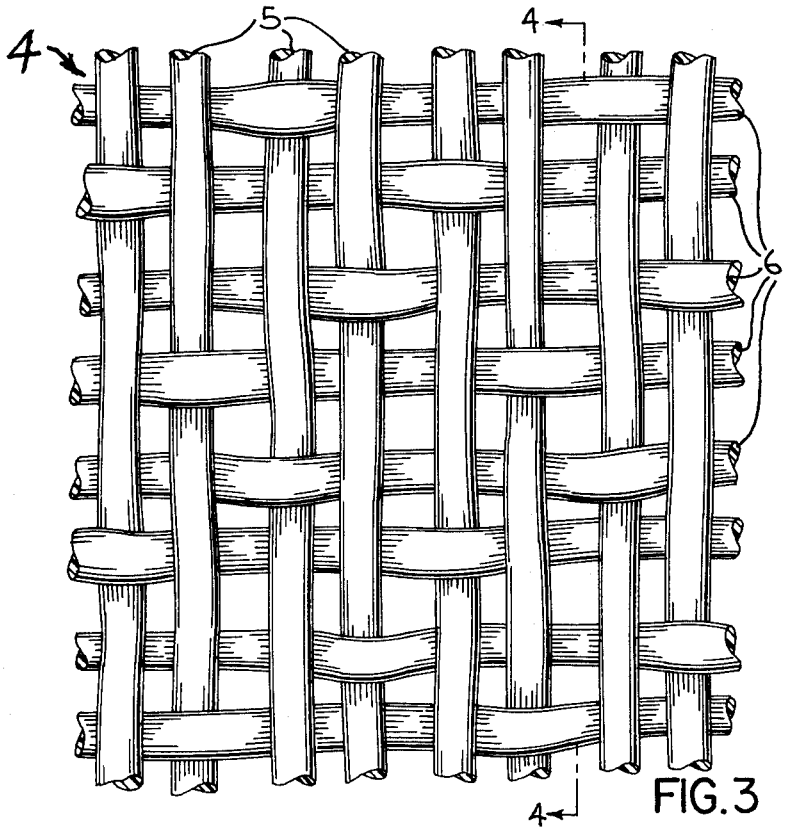
FIG. 3 is a fragmentary plan view of another fabric of the invention woven in a 1×3 weave.

Referring now to FIG. 3, there is shown a fragmentary portion in plan view of another fabric 4 also intended for use in a high temperature section of a paper machine. It is similar to that of FIGS. 1 and 2, having warp threads 5 extending in the machine direction and shute threads 6 extending in the cross machine direction. The weave is a 1×3 with the long warp knuckles being on the upper, or forming side of the fabric, and the long shute knuckles on the lower, or wear side of the fabric. As seen in FIG. 3, the 1×3 weave is in a satin pattern.

Figure 4:
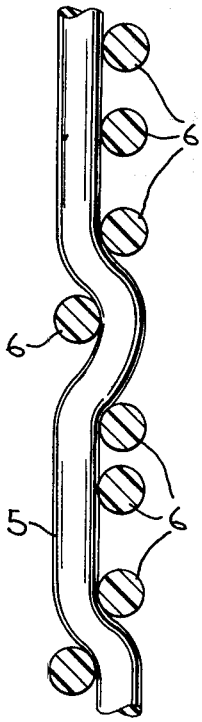
FIG. 4 is a view in cross section of the fabric of FIG. 3 taken through the plane 3—3 indicated in FIG. 3.

Polyaryletherketone monofilaments were again employed as the thread material for the fabric of FIGS. 3–4, with the monofilaments having a nominal diameter of 0.020 inch. The warp mesh count on the loom was 20 threads per inch at the reed, and after thermal setting there were 24 warp threads per inch and 21 shute threads per inch. On the long warp knuckle side the warp knuckles were recessed within the shute knuckles by about 0.004 inch, and on the long shute knuckle side the warp and shute knuckles were substantially in the same plane. The fabric thickness was about 0.0505 inch. For heat setting the temperatures were again higher than for other synthetic materials, a temperature of 500° F. (260° C.) being utilized. After heat setting, the fabric was formed into an endless belt by joining the fabric ends with a stainless steel, pin type loop seam.

Polyaryletherketone polymers suitable as the monofilament threads in the fabrics of this invention are:

(1) polyetherketones having the repeating unit

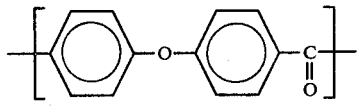

identified in the claims as —Φ-O-Φ-CO—, such as poly(benzophenone ether), or having the repeating unit

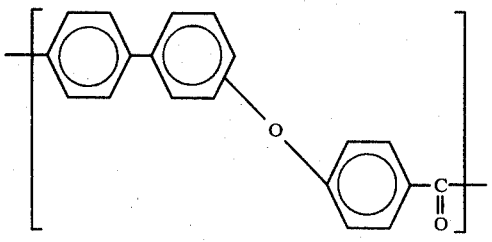

identified in the claims as —Φ-Φ-O-Φ-CO— such as homopolymers of para-biphenyloxybenzene and copolymers thereof having minor proportions of the corresponding ortho or meta monomers (or both); and (2) polyetheretherketones having the repeating unit

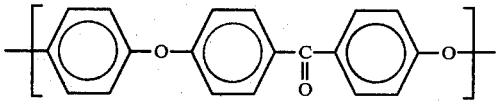

identified in the claims as —Φ-O-Φ-CO-Φ-O— such as polyetheretherketone prepared by nucleophilic polycondensation of bis-difluorobenzophenone and the potassium salt of hydroquinone.

The end groups in the above polymers may be phenoxy group from monohydric molecules added in small amounts (e.g. less than 0.1% by weight) to terminate the condensation reaction, and it is also possible that the end groups are not clearly understood and polymerization stops due to transient decomposition effects causing termination of the reaction depending upon time and temperature. The technical literature, see particularly the Attwood et al article in Polymer cited below, indicates molecular weight is regulated during the polycondensation reaction by slight imbalances in stoichiometry; in this case, it is conceivable that the end group would be a half-reacted bis-fluorophenol ketone leaving an exposed fluorophenyl structure of the type —CO—O—F.

Polyaryletherketone resins of the foregoing types are commercially available from several companies, including Raychem Corporation and Imperial Chemical Industries Limited. Suitable techniques for their preparation are described in Attwood et al, Synthesis and Properties of Polyaryletherketones, *Polymer,* Vol. 22, Aug. 1981, pp. 1096–1103; Attwood et al, Synthesis and Properties of Polyaryletherketones, *ACS Polymer Preprints,* Vol. 20, No. 1, April 1979, pp. 191–194; and EPO published application S.N. 78300314.8, Thermoplastic aromatic Polyetherketones etc. See also U.S. Pat. Nos. 3,751,398 and 4,186,262 and British Pat. Nos. 1,383,393, 1,387,303 and 1,388,013. The disclosures of the foregoing are incorporated herein by reference. Briefly, the resins may be prepared by Friedel-Crafts condensation polymerization of appropriate monomers using a suitable catalyst such as boron trifluoride. The polyaryletherketone resins suitable for the practice of this invention are to be melt extrudable, i.e. they should have appropriate molecular weights and intrinsic viscosities so as to be capable of extrusion into monofilament form.

A lubricant may be included with the resin that will function as an extruding agent, and calcium stearate in the amount of 0.05 to 0.2 percent, but preferably 0.1 percent, of the resin by weight may be used as such a lubricant. To prepare the resin for extending, it must be dried and all volatiles including water should be removed, for if the volatiles in the resin are not adequately removed undesirable voids may form in the extruded monofilament. Tumbling can be used while the resin is retained at 200° C. (392° F.) under a pressure of less than one mm mercury for four hours. This temperature compares with the resin melting temperature of 334° C. (633° F.). The resin is then cooled, either under vacuum or in a dry nitrogen atmosphere, and then charged to an extruder under a nitrogen blanket.

In extruding, the several extruder zones have been heated to 390° C. (734° F.) for the initial extruding, and as flow begins temperatures were reduced to 350° C. (662° F.) in the feed zone, 380° C. (716° F.) in the transition zone and metering zone, and 370° C. (698° F.) in the die zone. Spinerettes have been used like those for other extrusions, and a 0.040 inch die hole has been employed for a monofilament of a final 0.020 inch nominal diameter. Various filament sizes can be obtained by adjusting screw, pump and pull roll speeds, and final thread sizing is made in a subsequent drawing operation. A draw ratio of 3.3 to 1 in change in thread length followed by a 0.86 relaxation for a net draw of 2.84 to 1 has been used to obtain a nominal 0.020 inch diameter monofilament.

The polaryletherketones exhibit excellent retention of tensile strength at temperatures up to at least 500° F. (260° C.). The polyetheretherketones and the polyetherketones have similar characteristics. For example, the melting point of a typical polyetheretherketone of 334° C. (633° F.) compares with 365° C. (689° F.) for a typical polyetherketone, and the glass transition temperatures are respectively 143° C. (289° F.) and 165° C. (329° F.). To test their tensile stress retention under extended periods of heat, samples were subjected to constant exposure of 500° F. (260° C.) for twenty-one days. After such exposure the tensile strength of the polyetheretherketone was 100% of its original value, and that of the polyetherketone was substantially 90% of its original value. This is in comparison with a polyethylene terephthalate (PET) polyester subjected for twenty-one days to a temperature of 350° F. (177° C.) that lost 43% of its initial tensile strength. Because of the lower melting point of the PET polyester of 482° F. (250° C.), the comparative test for this material was run at the lower temperature of 350° F.

Figure 5:
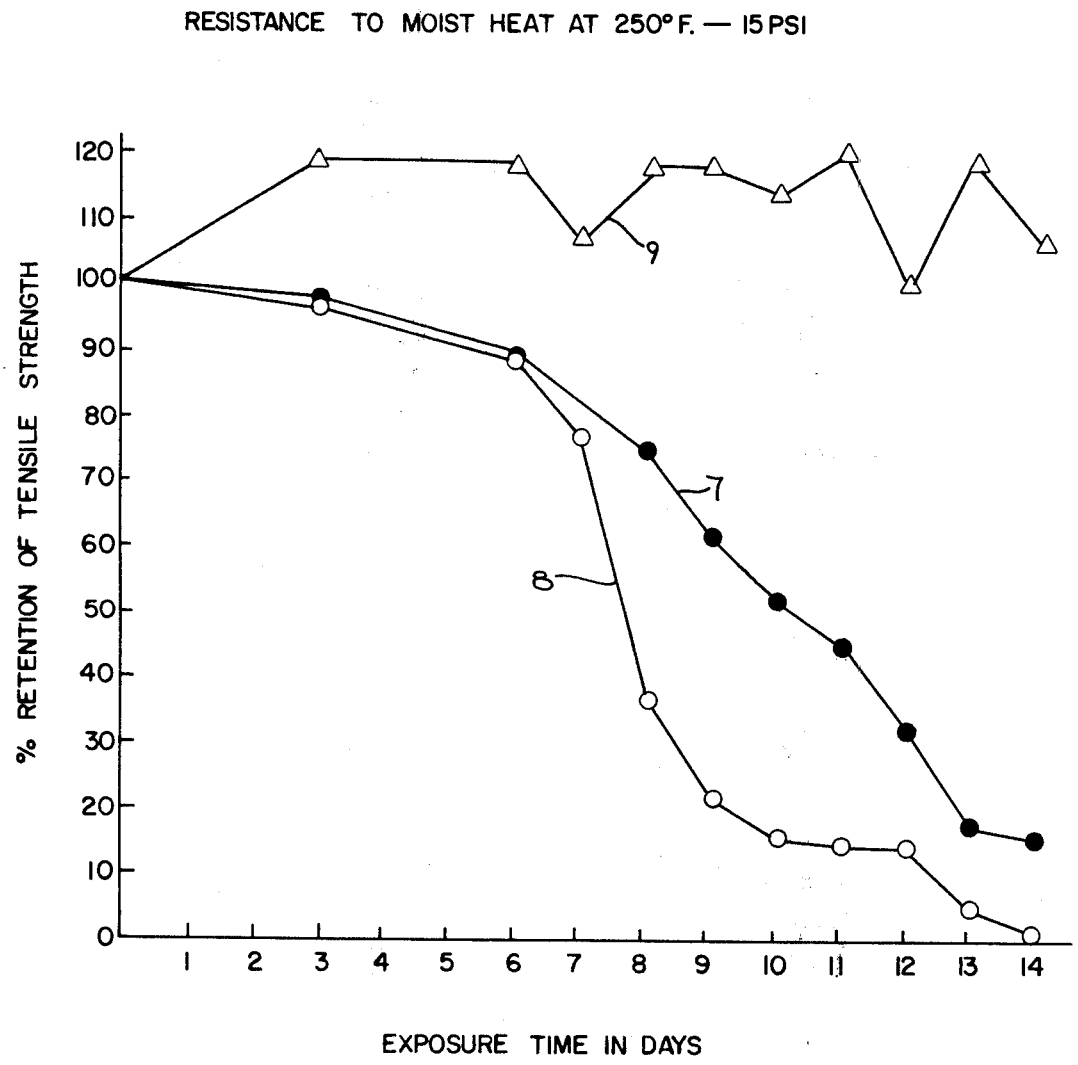
FIG. 5 is a graph showing the hydrolysis resistance of a thread of the fabric of the invention in comparison with other thread materials.

Tests of a polyetheretherketone under hot, moist conditions were conducted showing a high hydrolysis resistance. The results of such testing is shown in the graph of FIG. 5. Monofilaments of polyetheretherketone and of two control samples of polyester materials were subjected to 250° F. (121° C.) at 15 psi of steam for fourteen days. The percent of retention of original tensile strength is plotted at the left in FIG. 5 and the fourteen day test period runs along the horizontal coordinate. The two polyesters represented by the lines 7 and 8 virtually lost their tensile strength, while the polyetheretherketone represented by line 9 retained its original tensile strength. The polyaryletherketones thus exhibit hydrolysis resistance for industrial fabrics favorable for use in hot, moist conditions where more conventional materials are inadequate.

The polyaryletherketones also have a modulus of elasticity higher than PET polyester and a greater retention of tensile strength with increase in temperature. Such characteristics indicate good qualities for finished fabrics, and these materials also exhibit adequate flexibility for use where flexure for travel around conveyor, or machines rolls is a requisite factor.

Fabrics woven of monofilament polyaryletherketones have also exhibited desirable characteristics for conveying belts. The modulus of elongation under tension loading for sample fabric swatches has been as high as 6,000 and a level of 5,000 or more can regularly be achieved for fabrics of thread count and size of the foregoing examples. These values have been attained with relatively open meshes, having as high as a 30% open area for single layer fabrics. Where thread counts are increased and thread diameters correspondingly reduced, so that the total bulk of thread materials may be lessened, modulus of 4,000 is achievable. This renders the fabrics suitable for paper manufacture and other uses where fabric elongation must be controlled within narrow limits. In particular, for use on papermaking machines, open areas of single layer fabrics typically range between 17% to 30% of total fabric area, and by maintaining fabric modulus as high as 4,000 for such values of open area of fabrics of the invention are particularly suitable for paper manufacture.

Woven fabrics of the invention have also shown desirable characteristics at elevated temperatures, in addition to having hydrolytic resistance. The modulus of elongation at temperatures up to 400° F. (204° C.) has been comparable to that of fabrics of other materials, the tendency to shrink at elevated temperatures up to 400° F. (200° F.) has been less than other fabrics, and when under tension loading the internal stress of a fabric at elevated temperatures has been less than for comparable fabrics of other material. Thus, the invention provides in a fabric the combination of hydrolytic resistance with desirable characteristics of good modulus, little tendency to shrink and superior low stress at elevated temperatures of at least 400° F. (204° C.).

The invention thus provides an industrial fabric of high heat resistance in dry or moist conditions without material loss in tensile strength, making use of synthetic, melt extrudable polyaryletherketone resinous materials. While the fabric examples of FIGS. 1–2 and FIGS. 3–4 are comprised of polyaryletherketones for both warp and shute threads, it is within the scope of the invention to combine these threads with threads of other materials where desired. A mix of synthetic and metal threads may be had, for example, in fabrics used for making water jet pattern impressions in non-woven processing lines. The machine direction threads could be of the polyaryletherketone material and the cross machine threads of metal strands, either single or cabled. Fabrics utilizing the invention may also be of single layer or multi-layer construction, and the threads can be metalized or coated with resins or other compounds to produce specific surface characteristics.

Another construction could comprise Teflon cross machine threads combined with machine direction threads of the polyaryletherketone in order to enhance release of a sheet from the fabric. In multilayer fabrics the bottom layer cross machine threads can be of a more abrasion resistant material to take wear, while the cross machine threads of the upper layer can be of Teflon to again improve sheet release in a papermaking or similar process. Metal threads in one thread system, combined with synthetic threads of the invention can also be used for improved heat transfer or stiffening of the fabric. Thus, the invention can take a variety of forms for use in a variety of applications. These applications for a hydrolytic resistant fabric at elevated temperatures include drying and curing of products in various industries such as, for example, paper, non-woven, glass mat and food processing, and other uses will become apparent to those in various arts.

I claim:

1. A fabric having machine direction and cross machine direction threads interwoven with one another in a repeated pattern and finished into an endless belt, wherein certain of the threads are a monofilament of a melt extrudable polyaryletherketone selected from the group consisting of polyetherketones having repeating units of —Φ-O-Φ-CO— or —Φ-Φ-O-Φ-CO— and polyetheretherketones having repeating units of —Φ-O-Φ-CO-Φ-O—.

2. A fabric as in claim 1 having hydrolysis resistance for the threads thereof of maintaining 90% of tensile strength at temperatures up to 250° F.

3. A fabric as in claim 2, wherein certain of said threads are of said polyaryletherketone and others of said threads are of another synthetic, resinous material.

4. A fabric having machine direction and cross machine direction threads interwoven with one another in a repeated pattern and finished into an endless belt with threads of the belt being thermally set after weaving to stabilize the fabric; wherein certain of the threads are a monofilament polyaryletherketone having thermal resistance of 90% retention of tensile strength at temperatures up to 500° F.; and the fabric has a modulus of at least 4,000 for an open area of within thirty percent.

5. A fabric as in claim 4, wherein said polyaryletherketone is a polyetheretherketone.

6. A fabric as in claim 4, wherein certain of said threads are of said polyaryletherketone and others of said threads are of metal.

7. A fabric having machine direction and cross machine direction threads interwoven with one another in a repeated pattern and finished into an endless belt with the threads of the belt being thermally set after weaving to stabilize the fabric; wherein certain of the threads are of polyetheretherketone having hydrolysis resistance of maintaining 90% of tensile strength upon submission to moist heat of 250° F. at 15 compounds per square inch.

* * * * *

UNITED STATES PATENT AND TRADEMARK OFFICE

CERTIFICATE OF CORRECTION

PATENT NO. : 4,359,501

DATED : November 16, 1982

INVENTOR(S) : Venanzio DiTullio

It is certified that error appears in the above—identified patent and that said Letters Patent is hereby corrected as shown below:

Column 5, line 68, "extending" should read ---extruding---

Column 7, line 21, "of", second occurrence, should read - the -

Column 7, line 29, "(200°F.)" should read ---(204°C.)---

Column 8, line 31, "2" should read ---4---

Column 8, line 55, "compounds" should read ---pounds---

Signed and Sealed this

*Fifteenth* Day of *February 1983*

[SEAL]

*Attest:*

GERALD J. MOSSINGHOFF

*Attesting Officer*

*Commissioner of Patents and Trademarks*

REEXAMINATION CERTIFICATE (1272nd)

United States Patent [19] [11] B1 4,359,501

DiTullio [45] Certificate Issued May 8, 1990

[54] HYDROLYSIS RESISTANT POLYARYLETHERKETONE FABRIC

[75] Inventor: Venanzio DiTullio, Perth, Canada

[73] Assignee: Albany International Corp., Appleton, Wis.

Reexamination Request:
No. 90/000,891, Oct. 28, 1985

Reexamination Certificate for:

| | |
|---|---|
| Patent No.: | **4,359,501** |
| Issued: | **Nov. 16, 1982** |
| Appl. No.: | **315,925** |
| Filed: | **Oct. 28, 1981** |

[51] Int. Cl.[5] ..... B32B 5/06
[52] U.S. Cl. ..... 428/245; 139/383 R; 139/420 A; 139/383 A; 428/259
[58] Field of Search ..... 428/245, 259; 139/383 R, 420 A

[56] References Cited

U.S. PATENT DOCUMENTS

| | | | |
|---|---|---|---|
| 400,579 | 4/1889 | Maddox . | |
| 2,208,090 | 7/1940 | Whittier | 139/408 |
| 2,992,469 | 7/1961 | Hose et al. | 28/75 |
| 3,279,504 | 10/1966 | Wagner | 139/419 |
| 3,858,623 | 1/1975 | Lefkowitz | 139/425 |
| 3,915,202 | 10/1975 | Curtis et al. | 139/425 |
| 4,105,495 | 8/1978 | Pai | 162/348 |
| 4,149,571 | 4/1979 | Burroughs | 139/383 |
| 4,159,618 | 7/1979 | Sokaris | 57/251 |
| 4,395,308 | 7/1983 | Dawes | 162/232 |

OTHER PUBLICATIONS

Provisional Data Sheet, ICI Plastics Division, entitled Polyetheretherketone, dated Nov., 1979.
Research Disclosure, dated May, 1979, p. 242, No. 18 127.
Swiss Plastics article entitled Polyetheretherketone (PEEK), A New High Performance Thermoplastic, C. P. Smith, Nov. 1980.
Polyaryletherketone: high performance in a new thermoplastic by T. C. Stening, C. P. Smith and P. J. Kimber, Modern Plastics, Nov. 1981, pp. 86, 87 and 89.
Textile Terms and Definitions, Seventh Edition, The Textile Institute, 1975, frontispiece, preface, contents, pp. 42, 76–79, 127, 227–228.
REFRASIL Product Data Bulletin Cordage and Yarn, dated Dec., 1975.
REFRASIL Application Bulletin R-2/3, dated Feb. 1979.
Hitco REFRASIL Non-Asbestos Textiles Technical Data Bulletin, dated May, 1981, replaces '79 edition.
REFRASIL Product Data Bulletin Cloth, dated Oct., 1979.
REFRASIL Product Data Bulletin Batt & Fiber, dated May, 1980.
REFRASIL Product Data Bulletin "Irish", dated May, 1980.
REFRASIL Product Data Bulletin AR100 Series Cloth, dated May, 1980.
Hitco REFRASIL Non-Asbestos Textiles Technical Data Bulletin, dated May, 1981.
Hitco REFRASIL Non-Asbestos Textiles Application Bulletin, dated Nov., 1981.
Hitco AR Series REFRASIL Non-Asbestos Textiles Product Data Bulletin, dated Feb., 1981, reprint of '82.
NEXTEL 312, Ceramic Fiber Products by 3M, Apr. 1, 1980.
Booklet entitled NEXTEL 312 Ceramic Fiber From 3M, Donald D. Johnson Introduction, 283–296. Reprinted from Journal of Coated Fabrics, vol. 11 (Apr., 1981). Presented at the 67th Annual Convention.
Canvas Products Association International, Toronto, Canada, 11/16/79.
New High Temperature Continuous Ceramic Fibers, author Donald D. Johnson, 3M Co., St. Paul, Minn., published 1975, cover pages and pp. 164–180, Apr. 29–May 1, 1975.

*Primary Examiner*—Marion E. McCamish

[57] ABSTRACT

An industrial fabric of woven monofilament threads comprised of a melt extrudable polyaryletherketone having hydrolysis resistance at elevated temperatures, such fabric exhibiting a high modulus of elongation making it suitable for conveying applications in various industrial processing.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-7 having been finally determined to be unpatentable, are cancelled.

* * * * *